US006719261B2

(12) United States Patent
Wadsworth

(10) Patent No.: US 6,719,261 B2
(45) Date of Patent: Apr. 13, 2004

(54) POST SUPPORT APPARATUS AND METHOD OF USE

(76) Inventor: George William Wadsworth, P.O. Box 879, Dunedin, FL (US) 34697

( * ) Notice: Subject to any disclaimer, the term of this patent is extended or adjusted under 35 U.S.C. 154(b) by 5 days.

(21) Appl. No.: 10/411,732

(22) Filed: Apr. 11, 2003

(65) Prior Publication Data

US 2003/0189156 A1 Oct. 9, 2003

Related U.S. Application Data

(63) Continuation-in-part of application No. 09/839,758, filed on Apr. 23, 2001, now abandoned.

(51) Int. Cl.[7] ..... F16M 13/00
(52) U.S. Cl. ..... 248/511; 248/514; 248/530
(58) Field of Search ..... 248/511, 514, 248/515, 530, 544, 545, 507, 508

(56) References Cited

U.S. PATENT DOCUMENTS

| | | | | | |
|---|---|---|---|---|---|
| 2,502,807 | A | | 4/1950 | Temmer | 119/786 |
| 2,554,887 | A | * | 5/1951 | Tricarico | 248/545 |
| 3,115,726 | A | | 12/1963 | Sayles | 404/136 |
| 4,099,354 | A | | 7/1978 | DePirro | 249/151 |
| 4,275,535 | A | | 6/1981 | Statzer | 116/209 |
| 4,483,506 | A | * | 11/1984 | Litwiller | 248/545 |
| 4,753,411 | A | * | 6/1988 | Lechner et al. | 248/533 |
| 4,913,428 | A | | 4/1990 | Nauman | 135/118 |
| 5,048,240 | A | | 9/1991 | Dupre et al. | 135/118 |
| 5,186,436 | A | | 2/1993 | Cummings, Jr. | 254/29 R |
| 5,487,656 | A | | 1/1996 | Kaitanjian | 404/89 |
| 5,632,464 | A | | 5/1997 | Aberle | 248/530 |
| 5,649,690 | A | | 7/1997 | Kilmer | 248/156 |

* cited by examiner

*Primary Examiner*—Ramon O. Ramirez
(74) *Attorney, Agent, or Firm*—Michael E. McKee

(57) ABSTRACT

An apparatus for supporting a metal post while it is being driven into the ground utilizes a platen base and a guide member which is joined to the base for holding the post in a steady condition while the post is being driven into the ground. The post is insertable endwise into the guide member and is engageable with the ground through a through-opening defined in the base. As a user stands upon or beside the base with his feet positioned on opposite sides of the through-opening, both of his hands are free to use a driver to drive the post into the ground. Therefore, this apparatus allows an individual to drive a post into the ground without the aid of another individual.

16 Claims, 4 Drawing Sheets

POST SUPPORT APPARATUS AND METHOD OF USE

This is a continuation-in-part of application Ser. No. 09/839,758 filed Apr. 23, 2001 now abandoned and entitled T-POST SUPPORT, the disclosure of which is incorporated herein by reference.

BACKGROUND OF THE INVENTION

This invention relates generally to tools and relates, more particularly, to means and methods for use when pounding, or driving, a post into the ground.

One class of post capable of use with the present invention is a metal t-post. A t-post has a substantially T-shaped cross section to facilitate the mounting of wire supports, metal signs or other articles desired to be supported by the post. T-posts are commonly used to build a fence on a farm where the posts are pounded into the ground before fence wire is attached to the posts. Usually, t-posts are pounded vertically into the ground, but there may be situations in which it is desired to orient a t-post at an angle with respect to the vertical.

A search of prior inventions in the U.S. Patent and Trademark Office revealed tools (such as those shown and described in U.S. Pat. Nos. 5,356,101 and 5,735,310) for a supporting a t-post after it is placed into the ground, and another tool (such as that shown in U.S. Pat. No. 5,794,918) which is used to pull a post out of the ground. However, no tool was found which is used to hold a post steady while it is being pounded into the ground.

Accordingly, it is an object of the present invention to provide a new and improved apparatus for holding a post steady while it is being driven into the ground.

Another object of the present invention is to provide such an apparatus which enables an individual to drive a post into the ground without the aid of another individual who may otherwise be required to hold the post steady while it is being driven into the ground.

Still another object of the present invention is to provide such an apparatus for holding a post at an angle with respect to the vertical as it is being driven into the ground.

Yet another object of the present invention is to provide such an apparatus which is uncomplicated in structure, yet effective in operation.

SUMMARY OF THE INVENTION

This invention resides in a support apparatus for supporting a post which is to be driven into the ground by an individual wherein the post has a ground-engaging lower end and a method of using the apparatus.

The apparatus includes a platen base for resting upon the ground and wherein the base has an upper surface upon which an individual can stand while the post is being driven into the ground. In addition, the base defines a through-opening which is located within the upper surface of the plate so that when an individual stands upon the upper surface while the post is being driven into the ground, the through-opening is disposed between the feet of the individual.

The apparatus also includes guide means which provides an elongated cavity having two opposite ends, and the cavity is sized to slidably receive a post inserted end-wise therein. Furthermore, the guide means is attached to the base so that the cavity of the guide means is positioned in registry with the through-opening of the base so that when an individual stands upon the base with his feet disposed on opposite sides of the through-opening and a post is received by the cavity so that the lower end of the post engages the ground through the through-opening of the base, the post is supported by the guide means in a steady condition for being driven into the ground. The cavity of the guide means is at least about twelve inches in length to enhance the steadiness of the post while it is positioned within the guide means.

The method of the invention includes the steps involved in using the apparatus of the invention. In particular, the apparatus is provided, and the base is positioned upon the ground so that the lower surface of the base engages the ground and the through-opening is disposed in registry with the location at which a post is desired to be driven. A post is then inserted lower-end first into the cavity of the guide member so that the lower end of the post engages the ground through the through-opening of the base. The post is then driven into the ground as the individual impacts the upper end of the post with a post-driving tool.

DETAILED DESCRIPTION OF AN ILLUSTRATIVE EMBODIMENT

Figure 1:
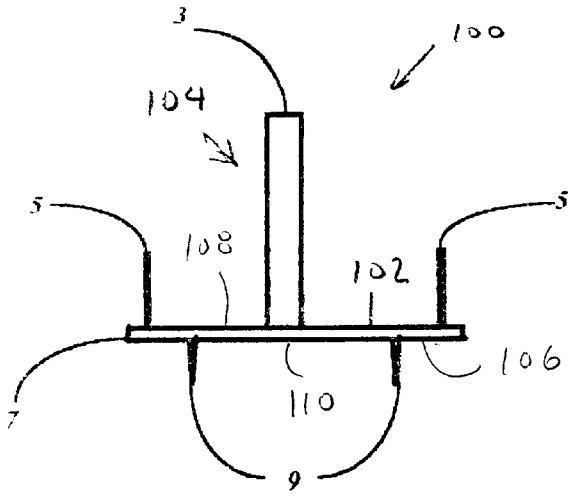
FIG. 1 is an elevational view of an embodiment of the support apparatus within which features of the present invention are incorporated, as seen from the front.
Figure 2:
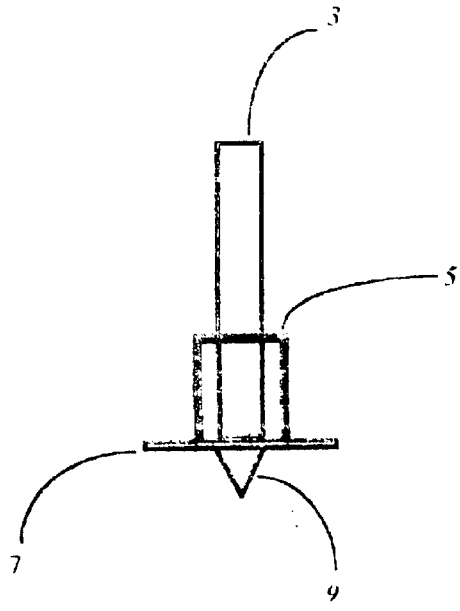
FIG. 2 is an elevational view of the FIG. 1 embodiment, as seen from the side.

Turning now to the drawings in greater detail and considering first FIG. 1, there is illustrated an embodiment, generally indicated 100, of a support apparatus within which features of the present invention are incorporated. The support apparatus 100 includes a platen base 102 which rests upon the ground and guide means, generally indicated 104, which cooperates the base 102 for supporting a post, such as a t-post, in a steady condition while the post is being driven into the ground.

The class of post with which this invention is concerned is preferably constructed of steel and has a lower end which is adapted to be driven into the ground while its opposite, or upper, end is pounded upon with a sledge hammer or comparable driver or driving tool. Accordingly, the post is designed to withstand repeated impact as its upper end is repeatedly struck with a driver as the post is being driven into the ground. In addition, such a post may be provided with a T-shaped, U-shaped, square, round or cross(+)-shaped cross section, although posts having alternative cross-sectional shapes can be had.

The posts which have a T-shaped cross-section are referred to herein as t-posts and are commonly used on a farm to support wire fences for containing livestock. Compared to the installation of posts having large cross-sectional areas, the installation of t-posts is relatively easy. Heretofore, however, the installation of t-posts usually require two people wherein one person is required to hold the post in a steady condition while the other person pounds upon the post with a driving tool. It is very difficult for one person to drive a post by himself because he would have to use one hand to hold the post steady while at the same time use the other hand to drive the post into the ground. The present invention is designed so that one person can drive a t-post into the ground without assistance from another person. Therefore and as will be apparent herein, the apparatus 100 is advantageous in that it permits a single individual to drive a post into the ground without the aid of another individual for holding the post steady as the post is being driven into the ground.

With reference again to FIG. 1, the platen base 102 has a lower surface 106 which rests upon the ground when the apparatus 100 is being used and has an upper surface 108 upon which an individual can stand as the post is being driven into the ground. In addition, the base 102 defines a through-opening 110 which extends between the upper and lower surfaces 106 and 108 of the base 102. The through-opening 110 is located along the upper surface 108 of the base 102 so that when an individual stands with his feet upon the base 102 for use of the apparatus 100, the individual's feet are disposed on opposite sides of the through-opening 110. The plate 102 is preferably constructed of steel, but other materials can be used.

Although the FIG. 1 embodiment 100 and, more particularly, its base 102 is adapted to be stood upon by an individual while the embodiment 100 is being used to drive a post into the ground, it is not necessary for an individual to stand upon every embodiment which incorporates features of the present invention during use of the embodiment. For example, an embodiment could be heavy enough to easily support a post in a stable condition for driving purposes without the user being required to stand upon the base of the embodiment (and thereby add his weight to the embodiment) to adequately stabilize the embodiment during use. In fact and as will be apparent herein in connection with an embodiment described herein facilitating the driving of a post into the ground at an angle, the design and/or shape of an embodiment can render it difficult for the user to stand upon the embodiment base during a post-driving operation. Accordingly, it will be understood that it is not always necessary for a user to stand upon the base of an embodiment in order for the embodiment to be used.

Figure 13:
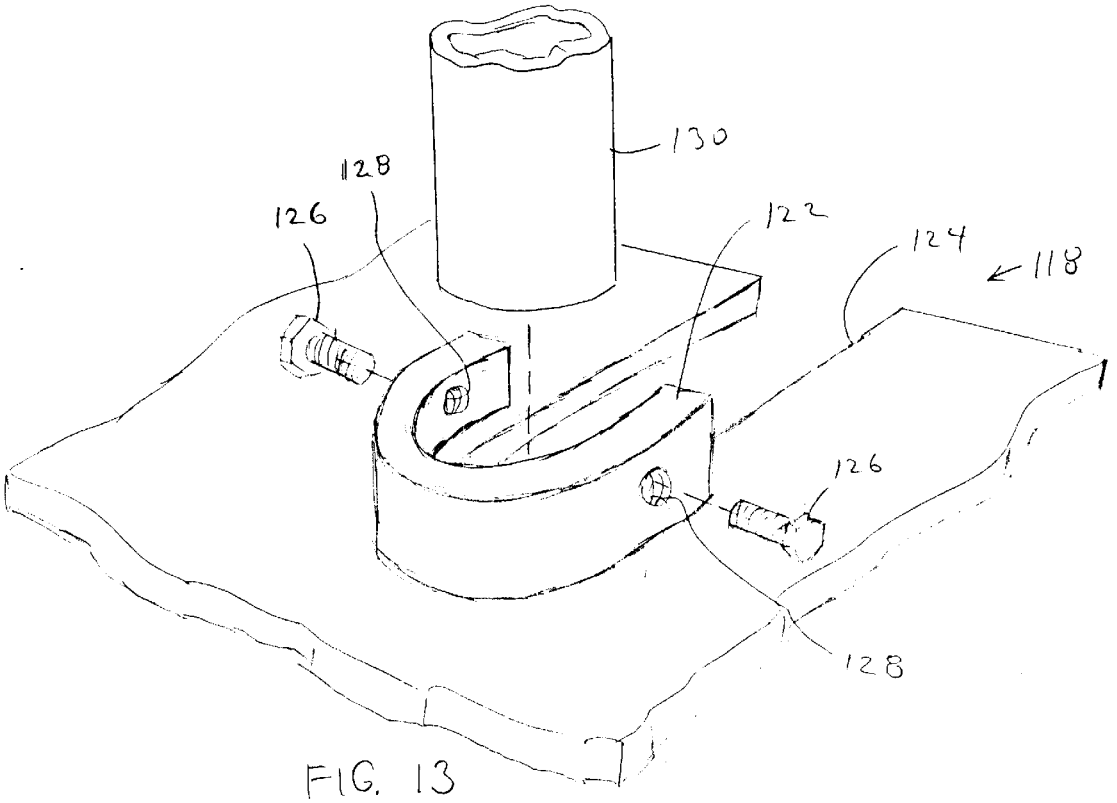
FIG. 13 is a fragmentary perspective view of one more embodiment of the support apparatus of the present invention, shown exploded.

In the interests of the present invention, the term "through-opening" is intended to mean any opening provided in the base through which a post desired to be driven into the ground is permitted to pass and can include, for example, the opening provided by a notch which opens along the side edge of the base (such as the notch 124 of the FIG. 13 apparatus 118). As will be apparent herein and upon completion of a post-driving operation, a base whose through-opening is provided by a notch may be simply withdrawn sideways from a post whereas a through-opening which is provided by a circular hole will likely require that the base be bodily lifted up and over the post to remove the base from the post.

To facilitate the transport of the FIG. 1 apparatus 100 between sites, the apparatus 100 includes a pair of handles 5 which are attached to the base 102 along the upper surface 108 thereof and on opposite sides of the through-opening 110. Preferably, the handles 5 are spaced far enough away from the through-opening 110 so that each foot of an individual who uses the apparatus 100 can be positioned between the through-opening 110 and the handle 5 which is positioned to one (i.e. the corresponding) side of the through-opening 110.

With reference still to FIG. 1, the guide means 104 includes a member, described herein, which provides an elongated cavity having two opposite ends wherein the cavity is sized to slidably receive a post, such as a t-post, inserted endwise therein and so that when inserted therein, the surfaces of post are closely spaced to the inside surfaces of the cavity. In the depicted embodiment 100, the cavity is provided by the interior of a hollow cylinder or shaft 3 which extends between the opposite ends of the shaft 3. Furthermore, the shaft 3 is joined to the base plate 102 so that the cavity is positioned in registry with the through-opening 110 of the plate 102. Therefore, when a post is inserted endwise through the cavity of the shaft 3, the lower end of the post is engageable with the ground through the through-opening 110 of the base plate 102. To enhance the capacity of the guide means 104 to steady the post as it is being driven therethrough, the cavity provided by the guide means 104 is at least twelve inches in length, and the cavity of the shaft 3 includes a cross section which is shaped complimentary to the cross-sectional shape of the post received thereby.

In the depicted FIG. 1 embodiment 100, the shaft 3 is joined to the base 102 at a right angle with respect thereto so that the post which is driven into the ground with the aid of the apparatus 100 will be oriented at a right angle with respect to the ground. More specifically and to use the apparatus 100, an individual inserts a post (e.g. a t-post) into the cavity of the shaft 3 so that lower end of the post engages the ground through the through-opening 110, and then the individual can stand upon the base 102 with his feet positioned on opposite sides of the through-opening 102. With the post supported within the shaft 3 in this manner, the base 102 and post are prevented from shifting laterally with respect to the ground and both hands of the individual are free to pound the post into the ground with a driver as the post is supported in a steady condition within the guide means 104. It follows that as the post is driven into the ground by the individual, the post is free to slide downwardly through the cavity of the shaft 3 as the post is maintained in a steady condition for continued driving.

Preferably, the shaft 3 is releasably joined to the base 102 so that upon completion of a post-driving operation, the shaft 3 can be detached from the base 102 and lifted up and over the post without also having to lift the weight of the base 102 with that of the shaft 3. If the through-opening of the base 102 is a circular opening, then the base 102 will also have to be lifted up and over the post, but if the through-opening is a notch which opens out of a side edge of the base, the base 102 can be removed from the post by sliding the base sideways as the notch is guided along the post.

Figure 10:
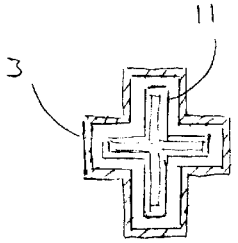
FIG. 10 is an enlarged view of a cross-section of the shaft of the FIG. 10 apparatus.
Figure 11:
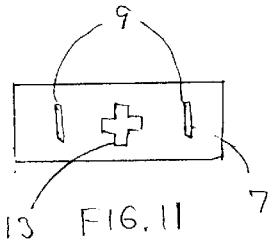
FIG. 11 is a bottom view of the FIG. 9 apparatus showing its plate, vertical cylinder and optional spikes.

Referring to the various Figures, the shaft 3 has a cavity 11 that accommodates, or slidably accepts, the cross-section of a t-post and is attached to the base 102 (which, in the depicted apparatus 100 is in the form of a plate 7) to form a right angle with respect to the plate 7. The plate 7 has a through-opening in the form of a cavity 13 that accommodates, or accepts, the cross-section of the t-post. In the preferred embodiment, the shaft 3 and plate 7 are metal and are joined to one another by bolts or screws. The cavity 11 of the shaft is of suitable shape and sufficient size to slidably receive the post inserted endwise therein and to hold the post with a minimum of play as is shown in the cross-sectional view of FIG. 10.

To stabilize the plate 7 as the apparatus 100 is being used, the apparatus 100 includes anchor means, generally indicated 112 (FIG. 8), for holding the plate 7 firmly in place against the ground. In the depicted FIG. 7 embodiment, the anchor means 112 is in the form of protrusions 9, such as downwardly-extending spikes, which are joined to the lower surface of the plate 7 and are adapted to sink into the ground when the plate 7 is stepped upon by the user to anchor the plate 7 and thereby minimize its side-to-side movement. The handles 5 can be used to facilitate the removal of the apparatus after the post is set. As mentioned earlier and to remove the apparatus from a post which has been driven into the ground, the apparatus is lifted to slide the shaft 3 and plate 7 up and over the top of the post or, if the shaft 3 and plate 7 are detachable from one another, can be removed from (e.g. lifted up and over) the post separately.

Figure 3:
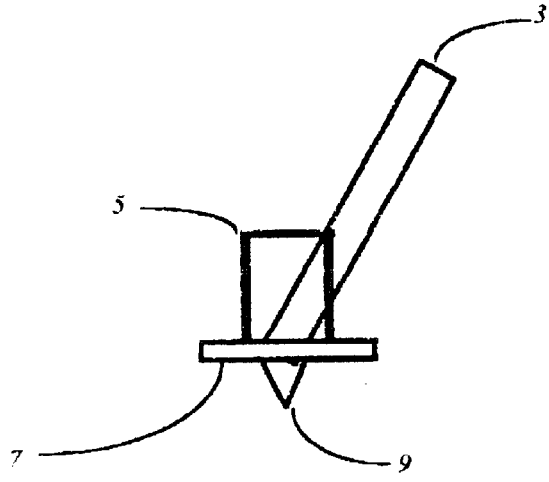
FIG. 3 is an elevational view, similar to that of FIG. 1, of another embodiment of the support apparatus.

One variation of the embodiment 100 of FIG. 1 is to have the shaft join the plate at an angle other than perpendicular, as is shown in FIG. 3. This might be desirable so that fence posts can be driven into the ground to accommodate a mowing machine. If the posts are slanted away from the pasture, animals grazing from within the pasture will reach through the fence and graze the other side of the fence. The mowing machine can mow beneath the wire near the posts but there is no need to crowd the post with the mower because the livestock has grazed there.

Figure 4:
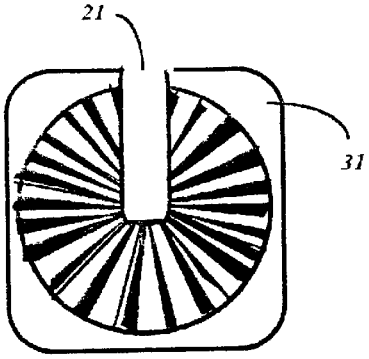
FIG. 4 is a view of a supporting member with grooved indentations for holding a removable vertical cylinder assembly.
Figure 5:
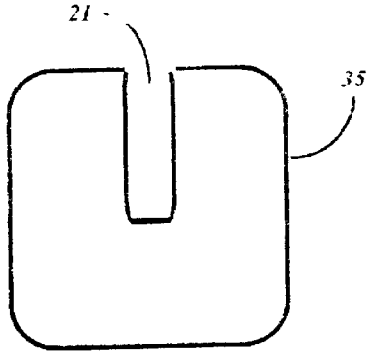
FIG. 5 is a view of a supporting member without grooved indentations for holding a removable vertical cylinder assembly.
Figure 6:
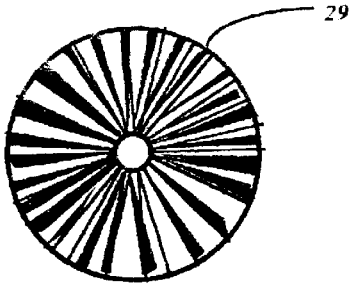
FIG. 6 is a view of a disc attachment to the removable vertical cylinder with grooved indentations that mesh with the grooved indentations of the supporting member.
Figure 7:
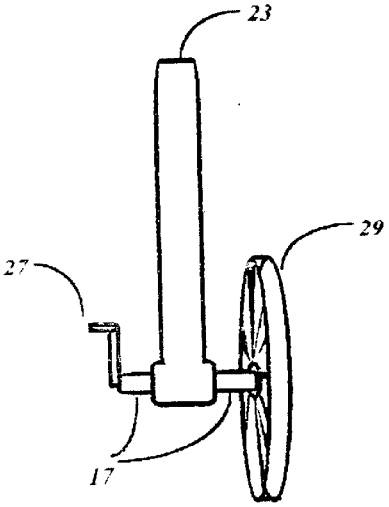
FIG. 7 is the front view of a removable cylinder with the disc attachment and an adjusting device.
Figure 8:
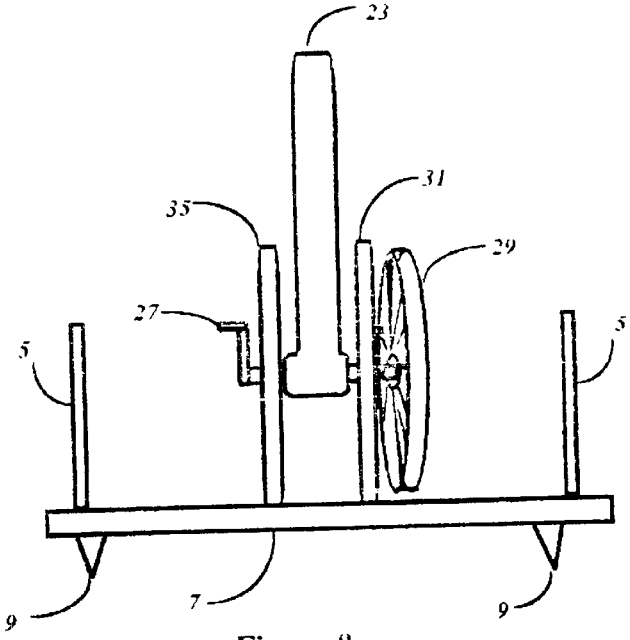
FIG. 8 is a front view showing the plate, optional handles and spikes, removable cylinder with the disc attachment and an adjusting device, and supporting members, one having grooved indentations for meshing with the disc of the vertical cylinder component.
Figure 9:
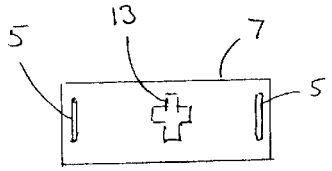
FIG. 9 is a top view of an alternative support apparatus showing its plate, vertical cylinder and optional handles.

Another variation takes into consideration the varying undulations of the ground. Consider the instance in which the plate would not lie horizontally upon the ground due to the unevenness of the ground. To ensure that the posts stand at the same angle from the horizontal, it is advantageous to be able to move the shaft from one angle to another. In one such embodiment, an adjusting device (like that used in golf pull-carts) may be used to re-position the angle of the shaft relative to the plate. If the shaft position can be alterable relative to the plate, then they can be joined together using a method, other than with bolts or screws, that allows the shaft to swing from the vertical. One example of a removable component comprising a cylinder 23 is shown in FIG. 7. With reference to FIGS. 4–8, the cylinder 23 is separable from the plate 7 and has a perpendicular supporting shaft 17, an adjusting device 27, and a grooved disc 29. The plate has two supporting members, one ungrooved member 35 as seen in FIG. 5 and another member with grooved indentations 31, as seen in FIG. 4. The supporting shaft 17 rests in slots 21 of the supporting members 31 and 35.

Figure 12:
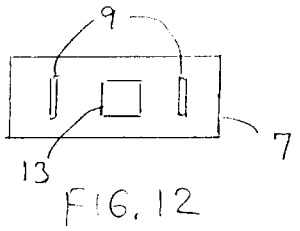
FIG. 12 is a view of the bottom of an apparatus wherein the cylinder is movable relative to the position of the plate showing the cavity in the plate shaped so as to accommodate the movement of the cylinder.

The cylinder 23 is adjusted with respect to the vertical by placing the cylinder 23 at a desired angle and engaging the adjusting device 27 so that the grooved indentations of the grooved disc 29 mesh with the grooved indentations of the supporting member 31. In this embodiment, the hole 15 in the plate 7 must accommodate the movement of the shaft and does not have to be shaped like the cross-section of the post. As shown in FIG. 12, the cavity 15 in the plate 7 can be rectangular or another shape necessary to allow the shaft to be moved from one position to another.

A further variation on this embodiment could include a built-in level so that the true vertical, or other desired angles, could be easily detected.

The advantage provided by an apparatus having a removable shaft is that the apparatus can, with the aid of shafts having cavities of alternative cross-sectional shapes, accommodate more than one shape of post using the same steadying plate. Fencing is not the only application for metal posts. For example, it is common to use posts to erect road signs or support utility meters or for other support purposes. The same invention can be used by a single worker having nothing more in his truck than the post, the support, and the driver. Sign posts have cross sections which are not normally shaped like a "T", but rather like a "U", or are even square or round in cross section. A variation of an embodiment which includes a plate and a shaft which are separable from one another is one in which the plate and shaft are fixedly attached to one another. Furthermore, a plate which can be detached from a shaft could be constructed to accommodate more than one type of shaft depending upon the cross-sectional shape of the post. For example, a single plate can be used to alternatively hold shafts intended to accept posts having a T, square, round or U-shaped cross section.

A person skilled in the art could think of many uses that have not been set forth in this document.

It will be understood that numerous modifications and substitutions can be had to the aforedescribed embodiments without departing from the spirit of the invention. For example, there is illustrated in FIG. 13 a base 120 for an apparatus, generally indicated 118, which is provided with a shoulder section 122 which extends upwardly from the upper surface of the base 120 and borders a portion of the perimeter of the through-opening 124. In addition, a pair of set screws 126 are threadably received by a pair of internally-threaded openings 128 provided in the sides of the shoulder section 122 so that by positioning the base of the cavity-defining shaft 130 in registry with the through-opening 124 and tightening the set screws 126 against the opposite sides of the shaft 130, the shaft 130 is releasably secured to the base 120.

This releasable securement of the shaft 130 to the base 120 in the FIG. 13 embodiment 118 facilitates the removal of the apparatus 118 from a post after the post has been driven into the ground. More specifically and to remove the apparatus 118 from the post, the set screws 126 are loosened to release the base 120 from the shaft 130, and then the shaft can be lifted over the post. Meanwhile, the base 120 is removed from the post by withdrawing the base 120 away from the post as the through-opening is guided from around the post.

Figure 14:
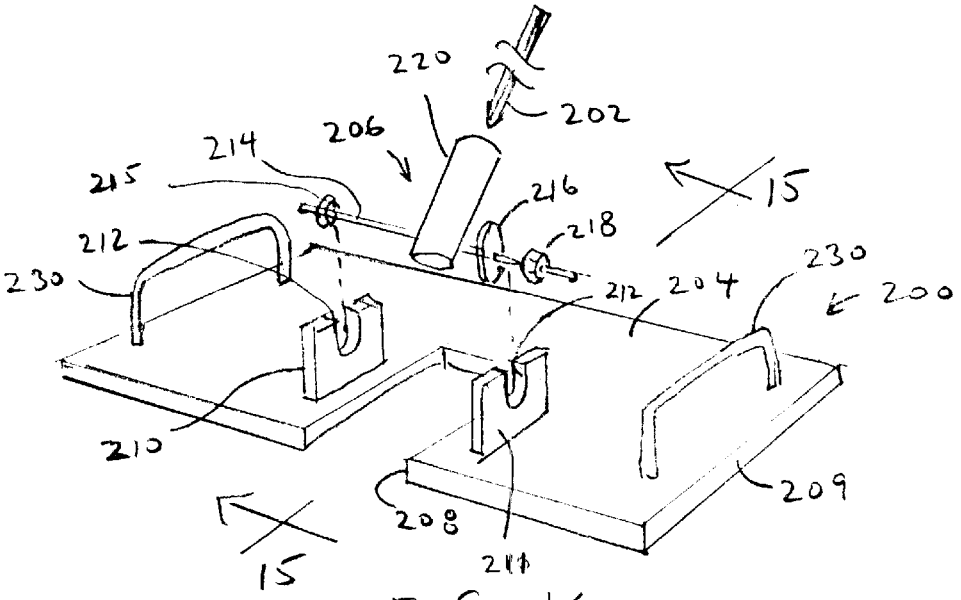
FIG. 14 is a perspective view of still one more embodiment of the support apparatus of the present invention, shown exploded.
Figure 15:
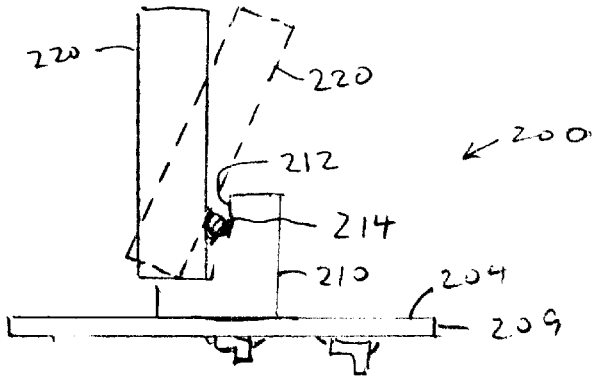
FIG. 15 is a cross-sectional view taken about along line 15—15 of FIG. 14.
Figure 16:
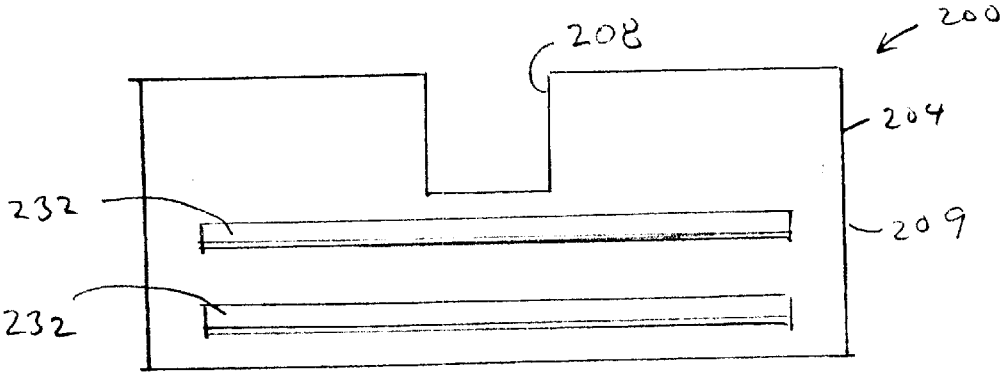
FIG. 16 is a plan view of the underside of the FIG. 14 embodiment.

Further still, there is illustrated in FIGS. 14–16 an embodiment 200 which is well-suited for use when driving a post, indicated 202, at an angle with respect to the underlying ground. The embodiment 200 includes a base 204 and guide means 206 which are attached to the base 204 for accepting the post 202 directed endwise therein. The base 204 includes a plate portion 209 having a notch 208 which opens out of one side edge thereof and a pair of shoulder support members 210, 211 attached to the plate portion 209 so as to be positioned on opposite sides of the notch 208. Each shoulder support member 210 or 211 includes an upwardly-directed groove 212 formed in the upper end thereof for supporting a steel rod 214 positioned across the notch 208. One end of the steel rod 214 is externally-threaded and threadably accepts a pair of locking nuts 216 and 218 thereon.

The guide means 206 of the embodiment 200 includes a post-accepting pipe 220 which is fixedly secured, as with welds, to a side of the steel rod 214 at a position thereon which is located about midway between the ends of the rod 214. When the rod 214, with pipe 220 attached, is operatively positioned within the grooves 212 of the support block members 210, 211, the lower end of the pipe 220 is disposed in registry with the opening provided by the notch 208 of the base plate portion 209 and the pair of locking nuts 216 and 218 are disposed on opposite sides of the support block member 211. When the nuts 216, 218 are in a loosened condition, the pipe 220 is free to be pivoted about the grooves 212 and relative to the base 204 between, for example, a position illustrated in solid lines in FIG. 15 and a position illustrated in phantom in FIG. 15.

It follows that the post 202 can be supported at a desired angular relationship with respect to the underlying ground by positioning the pipe 220 at a desired angle with respect to the plate portion 209 of the base 204 and then tightening the locking nuts 216 and 218 against the opposite sides of the support block member 211 so that the rod 214 and pipe 220 attached thereto are thereby prevented from rotating relative to the support block member 211. If desired (or necessary), a third nut 215 can be threadably accepted about the opposite end of the rod 214 for tightening against the outer surface of the support block member 210. With the rod 214 and pipe 220 secured to the support block member 221 in this manner, the post 202 can be positioned within the pipe 220 and stably held thereby for driving the post into the ground through the notch 208. Upon completion of a post-driving operation, the locking nuts 216 and 218 can be loosened from the support member 210 and the entire guide means assembly, comprising rod 214 and pipe 220 can be simply lifted from the grooves 212 of the support members 210 and 211 and subsequently lifted up and over the post 202. The base 204 is removed from the post by withdrawing the base 204 away from the post as the notch 208 is guided from around the post.

The embodiment 200 can also be equipped with handles 230 facilitating the movement of the base 204 between jobsites and angle members 232 (FIG. 16) secured to the underside of the plate portion 209 for providing stable footings for the embodiment 200.

Accordingly, the aforedescribed embodiments are intended for the purpose of illustration and not as limitation.

What is claimed is:

1. An apparatus for supporting a post which is to be driven into the ground by an individual wherein the post has a ground-engaging lower end, the apparatus comprising:

a platen base for resting upon the ground and having an upper surface upon which an individual can stand while the post is being driven into the ground, the base defining a through-opening therein which is located within the upper surface of the base so that when an individual stands upon the upper surface while the post is being driven into the ground, the through-opening is disposed between the feet of the individual; and guide means for providing an elongated cavity having two opposite ends, the cavity being sized to slidably receive a post inserted end-wise therein, and the guide means being attached to the base so that the cavity of the guide means is positioned in registry with the through-opening of the base so that when an individual stands upon the base with his feet disposed on opposite sides of the through-opening and a post is received by the cavity so that the lower end of the post engages the ground through the through-opening of the base, the post is supported by the guide means in a steady condition for being driven into the ground; and the cavity of the guide means is at least about twelve inches in length to enhance the steadiness of the post positioned within the guide means.

2. The apparatus as defined in claim 1 wherein the cavity of the guide means has a cross-sectional shape which is substantially complimentary in shape to that of the post which is to be driven into the ground with the apparatus.

3. The apparatus as defined in claim 1 wherein the guide means includes an elongated shaft member having a hollow interior, and the cavity is defined by the hollow interior of the shaft member.

4. The apparatus as defined in claim 1 including means for altering the angle of the cavity relative to the base to permit the angle of a post which is positioned within the guide means to be altered relative to the ground into which the post is to be driven.

5. The apparatus as defined in claim 1 further including a pair of handles which are attached to the upper surface of the base and on opposite sides of the through-opening, each handle being positioned at such a distance from the through-opening to permit a foot of the individual to be positioned between the through-opening and a corresponding handle as the individual stands upon the base during a post-driving operation.

6. The apparatus as defined in claim 1 further including means attached to the base for anchoring the base to the ground during a post-driving operation.

7. The apparatus as defined in claim 1 wherein the through-opening is a notch which opens out of one side edge of the base and the guide means is releasably secured to the base to facilitate the removal of the base and guide means from the post upon completion of a post-driving operation.

8. An apparatus for supporting a post desired to be driven into the ground by an individual wherein the post has a lower end which is engageable with the ground for being driven therein during a post-driving operation and an opposite upper end which is impacted by a driving tool as the post is being driven into the ground, the apparatus comprising:

a platen base adapted to rest upon the ground and having an upper surface upon which an individual can stand while the post is being driven into ground, the base defining a through-opening which extends between the upper and lower surface and which is located along the upper surface of the base so that when an individual stands upon the upper surface during a post-driving operation, the feet of the individual are disposed on opposite sides of the through-opening; and guide means for providing an elongated cavity having two opposite ends, the cavity being sized to slidably receive a post inserted endwise therein, and the guide means being attached to the base so that the cavity of the guide means is positioned in registry with the through-opening of the base so that when an individual stands upon the base with his feet disposed on opposite sides of the through-opening and a post is received by the cavity so that the lower end of the post is positionable against the ground through the through-opening in the base, the post is maintained in a steady condition by the guide means for being driven into the ground; and the cavity of the guide means is at least about twelve inches in length to enhance the steadiness of the post by the guide means and reduce the amount of play which could otherwise exist between the post and the cavity.

9. The apparatus as defined in claim 8 wherein the cavity of the guide means has a cross-sectional shape which is substantially complimentary in shape to that of the post which is to be driven into the ground with the apparatus.

10. The apparatus as defined in claim 8 wherein the guide means includes an elongated shaft member having a hollow interior, and the cavity is defined by the hollow interior of the shaft member.

11. The apparatus as defined in claim 8 including means for altering the angle of the cavity relative to the base to permit the angle of a post which is positioned within the guide means to be altered relative to the ground into which the post is to be driven.

12. The apparatus as defined in claim 8 further including a pair of handles which are attached to the upper surface of the base and on opposite sides of the through-opening, each handle being positioned at such a distance from the through-opening to permit a foot of the individual to be positioned between the through-opening and a corresponding handle as the individual stands upon the base during a post-driving operation.

13. The apparatus as defined in claim 8 further including means attached to the base for anchoring the base to the ground during a post-driving operation.

14. The apparatus as defined in claim 8 wherein the through-opening is a notch which opens out of one side edge of the base and the guide means is releasably secured to the base to facilitate the removal of the base and guide means from the post upon completion of a post-driving operation.

15. A method for driving a post into the ground by an individual wherein the post has a ground-engaging lower end and an upper end which is impacted by a driving tool as the post is being driven into the ground, the method comprising the steps of:

providing a support apparatus including a) a platen base for resting upon the ground and having an upper surface upon which an individual can stand while the post is being driven into the ground, the base defining a through-opening therein which is located within the upper surface of the base so that when an individual stands upon the upper surface while the post is being driven into the ground, the through-opening is disposed between the feet of the individual; and b) guide means for providing an elongated cavity having two opposite ends, the cavity being sized to slidably receive a post inserted end-wise therein, and the guide means being attached to the base so that the cavity of the guide means is positioned in registry with the through-opening of the base so that when an individual stands upon the base with his feet disposed on opposite sides of the through-opening and a post is received by the cavity so that the lower end of the post engages the ground through the through-opening of the base, the post is supported by the guide means in a steady condition for being driven into the ground, and the cavity of the guide means is at least about twelve inches in length to enhance the steadiness of the post positioned within the guide means;

positioning the base upon the ground so that the lower surface engages the ground and the through-opening is disposed in registry with the location at which a post is desired to be driven;

inserting a post lower-end first into the cavity of the guide member so that the lower end of the post engages the ground through the through-opening of the base; and driving the post into the ground by impacting the upper end of the post with a post-driving tool.

16. The method as defined in claim 15 wherein the step of driving is followed by a step of removing the support apparatus from the post.

* * * * *